US006404142B2

(12) United States Patent
Miyata et al.

(10) Patent No.: US 6,404,142 B2
(45) Date of Patent: Jun. 11, 2002

(54) STARTING DEVICE FOR DISCHARGE LAMP

(75) Inventors: Osamu Miyata, Machida; Hisao Hirata, Fujisawa, both of (JP)

(73) Assignee: Stanley Electric Co., Ltd. (JP)

( * ) Notice: Subject to any disclaimer, the term of this patent is extended or adjusted under 35 U.S.C. 154(b) by 0 days.

(21) Appl. No.: 09/754,233

(22) Filed: Jan. 2, 2001

(30) Foreign Application Priority Data

Mar. 10, 2000 (JP) ..... 2000-066434

(51) Int. Cl.[7] ..... H05B 41/16

(52) U.S. Cl. ..... 315/274; 315/276; 315/281; 315/57; 336/192; 336/96; 336/83

(58) Field of Search ..... 315/274, 281, 315/276, 209 R, 57, 82; 336/192, 96, 83, 219

(56) References Cited

U.S. PATENT DOCUMENTS 5,959,407 A * 9/1999 Ito et al. ..... 315/82
5,959,521 A * 9/1999 Kohmura et al. ..... 336/198
6,049,163 A * 4/2000 Masuda et al. ..... 313/318.12
6,066,921 A * 5/2000 Nakamura et al. ..... 315/71

FOREIGN PATENT DOCUMENTS

JP 8-222380 2/1995
JP 10-35357 7/1996

* cited by examiner

*Primary Examiner*—Don Wong
*Assistant Examiner*—Tuyet T. Vo
(74) *Attorney, Agent, or Firm*—Gifford, Krass, Groh, Sprinkle, Anderson & Citkowski, P.C.

(57) ABSTRACT

One of the objectives of the present invention are to provide smaller, lighter and less expensive structure in a starting device for discharge lamp for car use so as to prevent breakage due to vibrations etc . . . And another objective is to attain simultaneous electrical and structural connections between a high voltage electrode and a coil of a starting transformer. The device having the following constitution realizes the above-mentioned objectives. A starting device for a discharge lamp comprises a socket equipped with a high voltage electrode and a grounding electrode, a bobbin with a core-less structure, a starting transformer comprising a primary coil and a secondary coil wound around the bobbin. A screw electrode is arranged at the center of the end face of the bobbin. One end of the screw electrode is connected to an output terminal of the high voltage side of the secondary coil on the starting transformer. And the other end of the screw electrode is screwed and connected to a terminal of a high voltage side of the socket.

4 Claims, 17 Drawing Sheets

$V_{O-P-}$ = 19.2kV, t − = 400nsec $V_{O-P-}$ = 18.4kV, t − = 200nsec

STARTING DEVICE FOR DISCHARGE LAMP

BACKGROUND OF THE INVENTION

1. Field of the Invention

The present invention relates to a starting device for discharge lamp, particularly suitable to a lamp lighting device for vehicle headlights.

2. Brief Description of the Prior Art

The Lamp lighting device for vehicle headlights having a starting transformer equipped with a core is now widely used. In order to avoid an electric current saturation phenomenon that sometimes occurs in the starting transformer equipped with the above-mentioned core, a volume of the core has to be increased. In other words, inductance value in the ordinary transformer, usually equipped with the core, reaches a saturated value (corresponding to the inductance value of a core-less transformer), at a certain electric current value, as shown in FIG. 11 where inductance characteristic curves against electric current value are depicted.

Magnetic properties of the core are influenced by ambient temperature. FIG. 12 depicts relations between initial permeability ($\mu i$) of A type and B type cores used at a relatively lower temperature (below 100° C.) and at a relatively higher temperature (below 150° C.) respectively, and temperature T (°C.) so as to determine Curie temperatures in the respective core types.

The Curie temperature of A type is 174° C. for a lower temperature use and that of B type is 200° C. for a higher temperature use. Since a ferrite core has a critical temperature (Curie temperature) where the core transforms from ferromagnetic to paramagnetic, the ferrite core with the higher Curie temperature should be used at a higher temperature range (100° C.~200° C.).

When an HID lamp is employed as the discharge lamp, the core with Curie temperature above 200° C. should be selected for the starting transformer from a safety point, since heat from the lamp raises the temperature of the core up to ca. 150° C. when a starting circuit is arranged in a lamp socket due to a short distance between the lamp and the core. The higher Curie temperature of the core is, the lower an initial permeability ($\mu i$) of the core is (i.e. a lower inductance value when coil turns are kept constant), which means lower performance. Usually such core is not employed so that quantity of the commercially manufactured core is few, which naturally results in a cost increase.

When ferrite type cores are molded by an epoxy resin etc. for insulation, fatal defects such as ruptures or cracks are sometimes formed due to a shrinkage difference between the core and the molded resin. In order to avoid the above-mentioned defects caused by the shrinkage of the molded resin, the core has to be closed in a bobbin etc. or the core with a simple shape (round or rectangular rod etc.) has to be employed.

When a power is applied to the main body (not shown) of the lamp lighting device without mounting the lamp into a socket of the starting device for the discharge lamp, in the worst situations firing or fuming occurs likely due to a high voltage between two electrodes in the socket. Operators also likely suffer from electrical shocks when they fix the lamp lighting devices. As measures against the above-mentioned problems, check terminals etc. (terminals to detect mounting status of the HID lamp) as shown in FIG. 17, disclosed in the Japanese laid open patent No.10-50436, are attached to the lamp lighting devices In the conventional starting device for discharge lamp with the above-mentioned core, a supporting point of the core was easily broken by vibrations and impacts etc. because of a core weight. As measures against such breakage a core supporting mechanism was reinforced or other supporting members were added. Which resulted in a manufacturing cost increase.

In order to judge whether the HID lamp was mounted or not, additional detecting terminals, except existing two electrode terminals, had to be arranged in the socket, and a circuit (not shown) to process signals from the detecting terminals had to be added to the lamp lighting device.

SUMMARY OF THE INVENTION

The present invention is carried out in view of the above-mentioned problems so as to provide an inexpensively constituted, small sized and light weighed device free from breakage due to vibrations and impacts. The device attains electrical and structural connections simultaneously between high voltage electrodes and coils equipped in a starting transformer. And the present invention also provides a starting device for discharge lamp having a function where a power is supplied only when the lamp is mounted.

The starting device for discharge lamp is constituted as follows:

(1) The starting device for discharge lamp comprising; a socket equipped with a high voltage electrode and a grounding electrode for mounting the discharge lamp, a bobbin and a starting transformer having a core-less structure equipped with a primary and a secondary coils wound around the bobbin; wherein a screw electrode is arranged at the center of one end face of the bobbin, one end of the screw electrode is connected to an output terminal of the high voltage side of the secondary coil on the starting transformer and the other end of the screw electrode is screwed so as to be connected to a terminal of the high voltage side of the socket.

(2) The starting device for discharge lamp comprising; a socket for mounting the discharge lamp equipped with a high voltage electrode fitted to a movable electrode holder moved by a spring member and equipped with a grounding electrode for mounting the discharge lamp, a bobbin and a starting transformer having a core-less structure equipped with a primary and secondary coils wound around a bobbin; wherein an insulating wall is protruded by a spring mechanism when a discharge lamp is not mounted between a terminal of the high voltage side of the secondary coil and a grounding terminal; and the insulating wall is accommodated in a space at the center of the bobbin of the starting transformer when the discharge lamp is mounted.

(3) The starting device for discharge lamp according to (1) where the device is equipped with a harness with connector.

(4) The starting device for discharge lamp according to (2) where the device is equipped with a harness with connector.

BRIEF DESCRIPTION OF DRAWINGS

FIG. 5A is a front view. FIG. 5B is a side view. FIG. 5C is a cross sectional view along the I—I line in FIG. 5A. And FIG. 5D is a back view with socket case removed.

FIG. 6A is a front view. FIG. 5B is a cross sectional view along II—II line in FIG. 6A. And FIG. 6C is a cross sectional view with a lamp base fitted in the socket shown in FIG. 6B.

FIG. 8A is a front view. And FIG. 8B is a side view.

FIG. 9A is a view with a socket case removed. FIG. 9B is a view with the socket case fitted.

FIG. 10A is a circuit diagram employed in the first, second, third and fifth embodiments. FIG. 10B is a circuit diagram employed in the fourth embodiment.

FIGS. 14A to 14D show a first, a second, a third and a fourth methods respectively.

FIG. 15A shows a manner of the equal winding turns in each section of the bobbin. FIG. 15B shows a manner of decreased winding turns toward a high voltage side in the bobbin.

FIG. 16A shows a curve of the present embodiments. FIG. 16B shows a curve of the conventional starting device.

DETAILED DESCRIPTION OF THE PREFERRED EMBODIMENTS

Hereinafter detailed description of embodiments according to the present invention is explained by referring to FIG. 1 to FIG. 16A.

Figure 1:
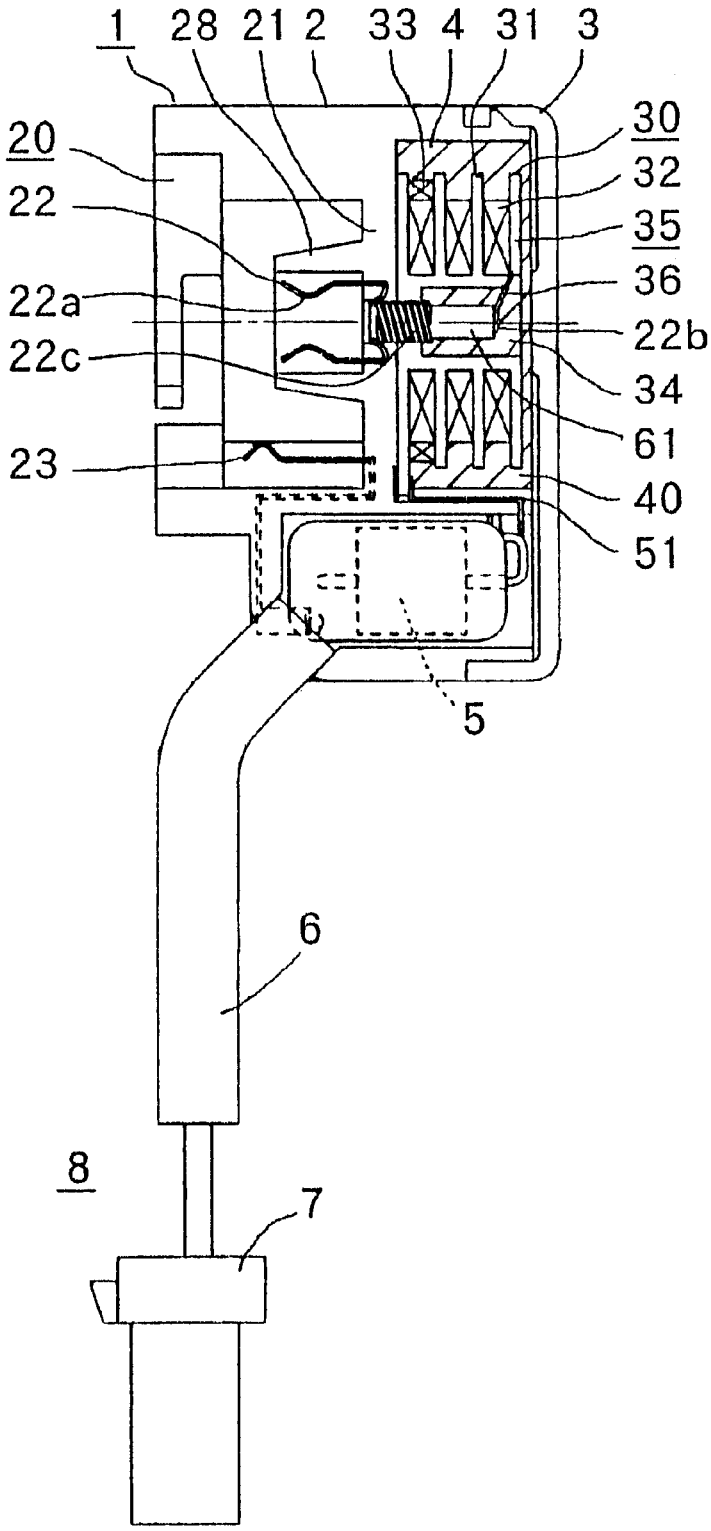
FIG. 1 is a cross sectional view depicting a constitution of a first embodiment according to the present invention.
Figure 2:
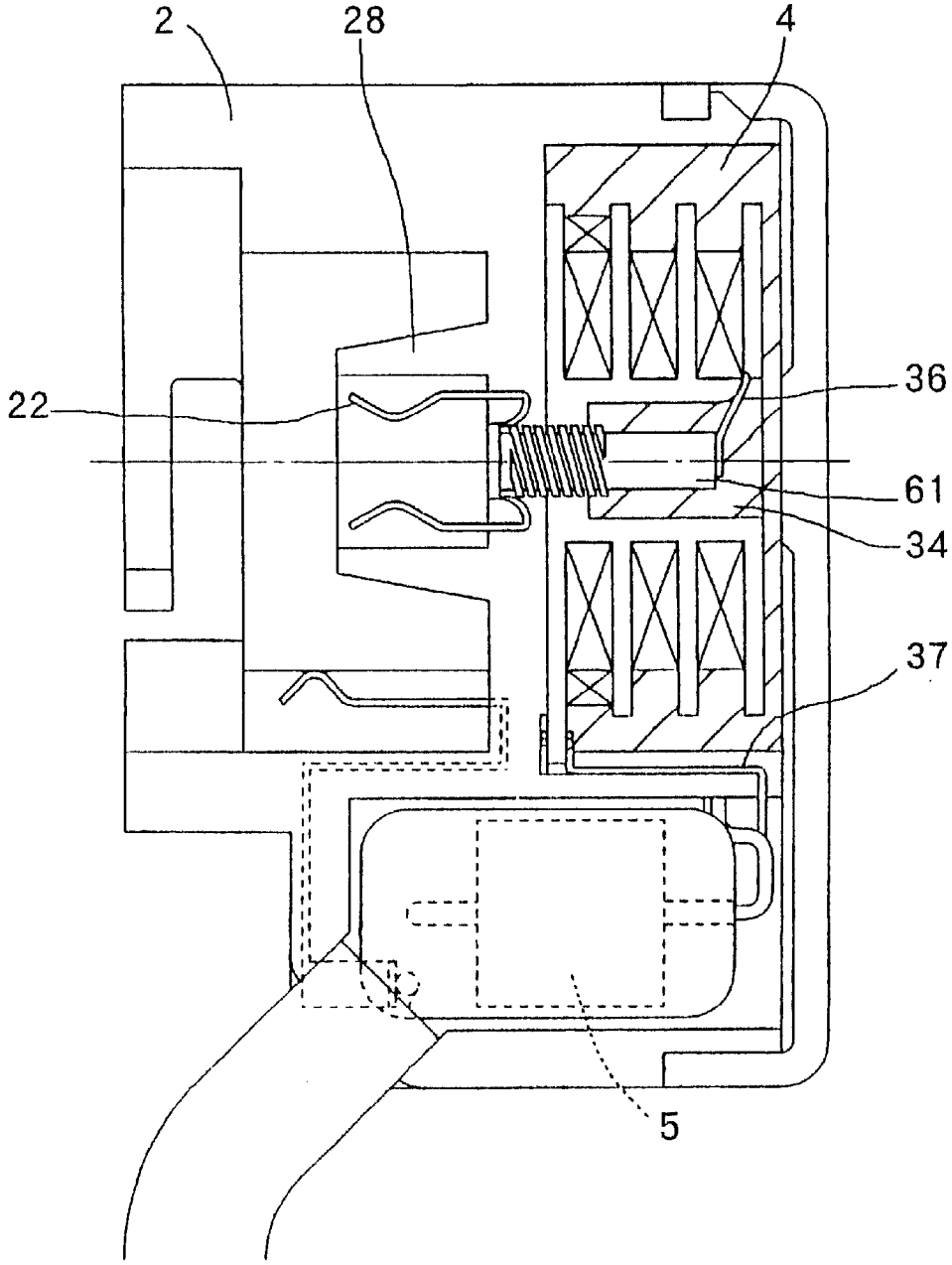
FIG. 2 is an enlarged view of the main portion of FIG. 1.

The first embodiment according to the present invention shown in FIG. 1 and FIG. 2 is explained. This embodiment relates to a starting device for lamp lighting equipped in a lamp lighting device for an HID lamp. The lamp lighting device includes power sources for the HID lamp and for a trigger element to generate a starting pulse etc. equipped in a main body (not shown) of the lamp lighting device. The starting device for lamp lighting is consisted of structural members such as parts for starting, an HID lamp socket etc. The main body of the lamp lighting device and the starting device for lamp lighting is electrically connected between a connector 7 equipped to the starting device for lamp lighting via a harness 6 and a direct coupler equipped to the main body of the lightning device.

A socket case 2 of a starting device 1 for lamp lighting for car use has a high voltage electrode 22 and a GND (grounding) electrode 23 formed by an insert molding or a direct insertion. Protruded portions 2*a* (quantity varies case by case) formed on the socket case 2 are fitted in cutout openings 3*a* formed on a rear socket case 3. (See FIG. 5B.)

Hereinafter an inside arrangement of a socket 20 constituted in the above-mentioned way is explained. An insulating wall 28 for insulation between the high voltage electrode 22 and the GND electrode 23 is formed, since a voltage between them reaches up to 20-odd kV. A high voltage leading electrode led out from a high voltage lamp receiving electrodes 22*a* of the high voltage electrode 22 surrounded by the insulating wall 28 is connected to a screw electrode 61. The screw electrode 61 extends thorough a separating wall 21 of the socket to a starting transformer accommodating space 4, namely to a center of the transformer, a core-less portion 34 (a hole accommodating a leading electrode 22*c* of the high voltage electrode 22 with a circular or rectangular cross-section of 1 to 10 mm in diameter). A high voltage transformer connecting electrode 22*b* formed at the end of the screw electrode is connected to a leading wire 36 at high voltage side a secondary coil 32.

At the bottom portion of the high voltage electrode 22 a female screw is formed while at one end of the screw electrode 61 built in the core-less portion of a bobbin 31 a male screw is formed. The leading wire 36 at high voltage side is connected to the other end of the electrode 61 by a welding or a high temperature soldering method. A coil 35 having a primary coil 33 and the secondary coil 32 is fixed by mating with the above-mentioned female screw formed on the high voltage electrode 22. A power output of a starting transformer 30 from the high voltage electrode 22 is attained via the above-explained mated screws (made of conductive materials). In other words the fixing (holding the starting transformer 30) and electrical connection are attained simultaneously.

The starting transformer 30 is consisted of the bobbin 31 (having a circular cross section in accordance with a geometry of the socket; Coil winding portions with a circular cross section are employed from a point of winding efficiency. Winding portions are divided into 3 to 6 sections.) in which the secondary coil 32 (100 to 400 turns, with 0.1 to 1.0 mm wire in diameter, in experiments 300 turns and 0.3 mm in diameter are employed.) is evenly wound around each winding section or more turns at a low voltage side than a high voltage side (See FIG. 15B where insulating property is improved by gradated turns.) A distributed capacity of the secondary coil 32 is increased by divided turns explained above.

The further apart from a magnetic center (in this case a winding center) the more increased the distributed capacity usually is. This capacity is a significant factor to increase a starting pulse width.

Figure 13:
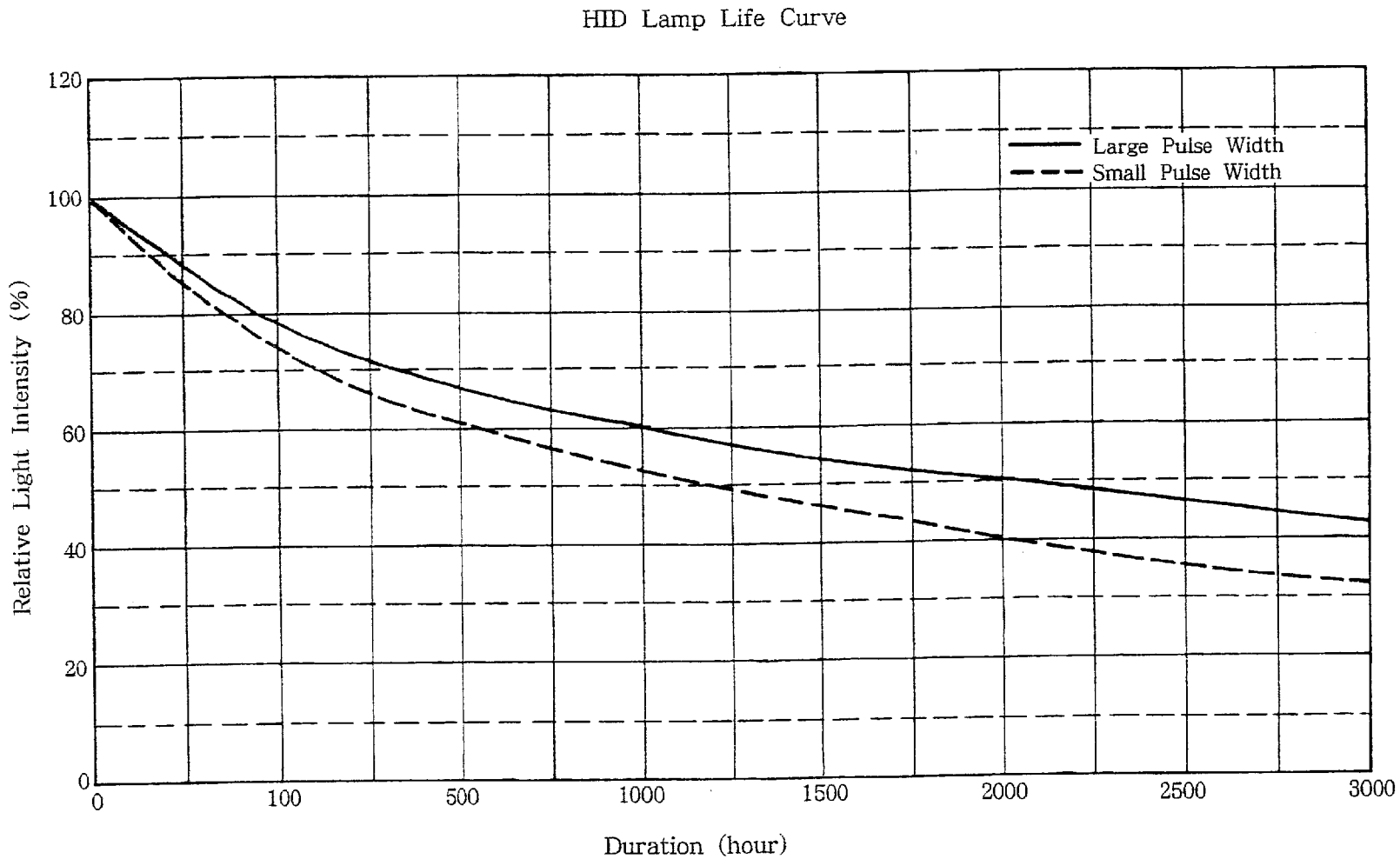
FIG. 13 depicts HID lamp intensity curves against duration in relation to pulse widths.

Our experiments proved that the distributed capacity is increased when more turns (overlapping turn) are formed at a narrow winding section so that the starting pulse width is increased, thus a life of an HID lamp is improved, since wearing a HID lamp electrode is suppressed as shown in FIG. 13. HID lamp life curves of a wide starting pulse width (0.4 msec) and of a narrow pulse width (0.2 msec) are plotted in FIG. 13 where an abscissa represents flashing duration of lamps and an ordinate represents relative light intensity. From this figure in case of the wide starting pulse width the light intensity seems to be deteriorated more slowly. A flushing mode of the lamp lighting device for car use in these experiments is as follows—after 5 cycles of ON (9 min. 45 sec.)/OFF (15 sec.) 10 min. OFF—. Since energy of the starting pulse (energy to start HID lamp) is usually determined by a product multiplied by the pulse width and a peak value of starting pulse voltage, the peak value can be decreased (to around limited value 20 kV) by increasing the pulse width. Namely, a boosted voltage ratio (turning number of primary coil/turning number of secondary coil) can be kept lower. As a result advantages such as obtaining a small sized transformer and an efficient transformer with less copper loss are attained by decreased turning number of the secondary coil.

The distributed capacity of the secondary coil with one rowed non-divided turn is ca. 0.001 pF, on condition that the turning number is kept constant (a starting circuit constant is kept as the same value by employing a flat wire with layered winding due to a dimensional restriction of the bobbin). In case of this distributed capacity, the starting pulse width is ca. 0.2 $\mu$sec and shows a steep starting curve. (See FIGS. 16A and 16B.)

On the bobbin 31 a wire with a circular cross section is wound in stead of a wire with a rectangular cross section considering a winding efficiency. (The wire with the circular section has the lowest copper loss when a cross sectional area and the number of the turn are kept constant due to the fact that the outer diameter of the wire, namely, a length of the wound wire amounts to the shortest.) A width of each divided section of the bobbin 31 is set several (an integer) times of the outer diameter (0.5~5.0 mm) of the wire so as to attain the most efficient winding. A wall thickness between the sections is set 0.5 to 2.0 mm. The primary coil 33 (1 to 10 turns, 0.1 to 1.0 in diameter. In our experiments a 4 turned coil by a wire having 0.5 mm in diameter is employed.) is arranged at the low voltage section of the secondary coil 32 (See FIG. 14A) considering a voltage difference between the primary and secondary coils. However, when a wire with high insulating property (withstand voltage: 10 to 20 kV) such as a wire with three layered insulation is used for the primary coil 33, the wire should be wound in a central area of the bobbin where a connection between the primary and the secondary coils is most preferable. (See FIG. 14B. In this case since the bobbin is divided into three, the middle section is most preferable.) Alternatively, sections in the bobbin 31 with evenly wound coil (See FIG. 14C) can be employed when good connection is attained.

Figure 14A:
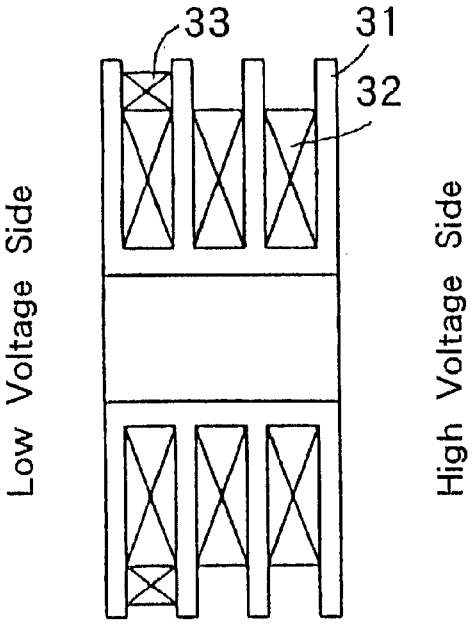
FIGS. 14A to 14D show winding manners in primary and secondary coils.
Figure 14B:
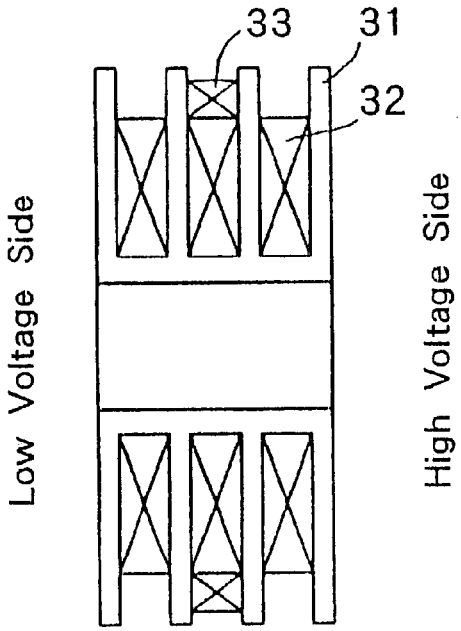
Figure 14C:
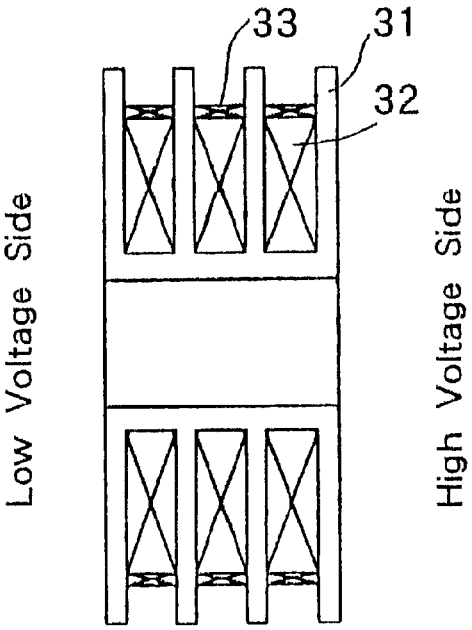
Figure 14D:
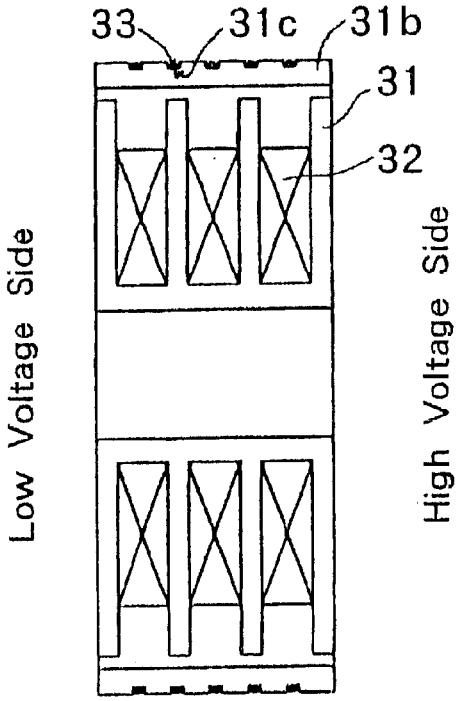
Figure 15A:
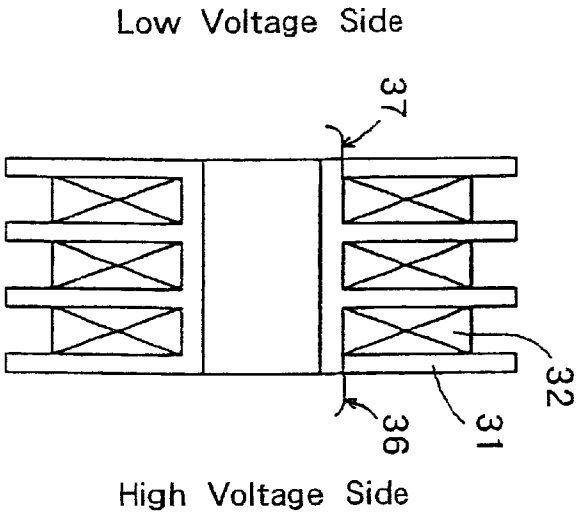
FIGS. 15A and 15B show winding manners in secondary coils.
Figure 15B:
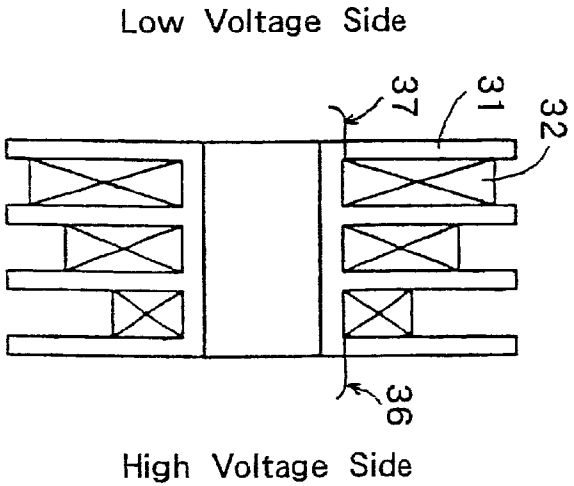
Figure 16A:
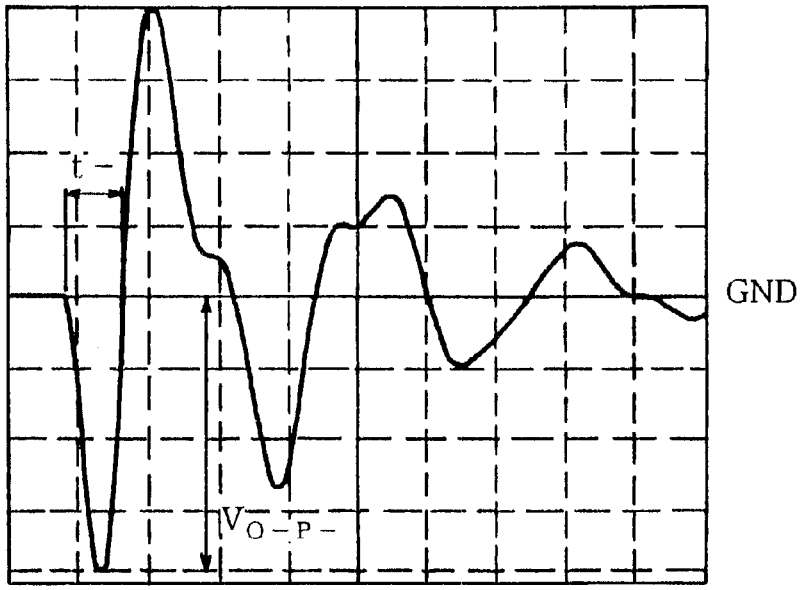
FIGS. 16A and 16B show transient curves of starting pulses.
Figure 16B:
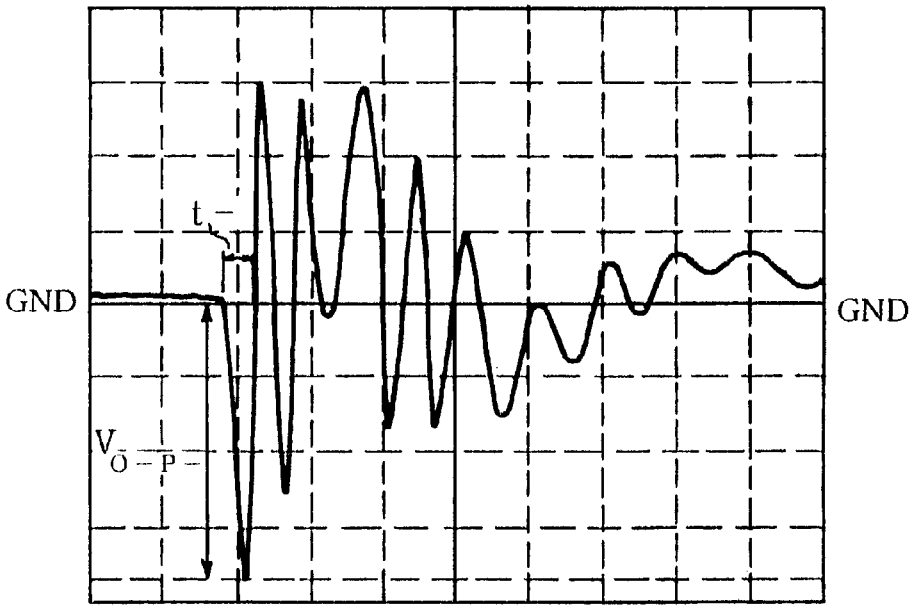
FIG. 16B (PRIOR ART)

The another alternative shown in FIG. 14D is constituted as follows: A bobbin case 31*b* is used as an insulating wall for preventing a leakage between the primary and secondary coils. On the primary coil a wire with a circular or rectangular cross-section is uniformly and sparsely wound around the outer diameter of the bobbin case 31*b*. Alternatively the wire is wound densely on the center section of the bobbin case 31*b*. On the bobbin case a groove 31*c* is formed spirally on the outer surface of the bobbin case 31*b* so as to ensure firm winding of the coil.

A leading wire 37 at a lower voltage side (see FIG. 2) of the secondary coil 32 and two leading wires 38 (see FIG. 5D) of the primary coil 33 are connected to three leading wire connecting points 50 (number is adjustable) formed on the bobbin 31. And these leading wires are lead to parts accommodating compartment 5 for the starting device via three slits 2*b* (see FIG. 5D) so as to trail on the side wall of a starting transformer accommodating compartment 4. Parts for a starting circuit accommodated in the parts accommodating compartment 5 for the starting device are connected to a connecting board 29 (See FIG. 5D) connected to the starting transformer and a harness assembly 8, by welding or high temperature soldering. (Since this portion is located near the HID lamp so that the ambient temperature reaches ca. 150° C., a low temperature solder usually employed in organic circuit boards is not suitable.)

The leading wires 37 and 38 are contacted with the starting transformer accommodating compartment 4 closely via a clip 51 in order to avoid these leading wires from contacting the coil 35 (particularly the secondary coil 32, to ensure insulation).

After accommodating the starting transformer in the accommodating compartment 4, only the starting transformer 30 is molded with a molding material. (an epoxy resin, a urethane resin, a silicon resin and the like) Sometimes the parts accommodating compartment 5 for starting device is molded after arranging parts for the starting circuit in it for ensuring insulation, protection against humidity and vibration, and a stable fixture of parts.

A GND electrode 23 is connected to the parts accommodating compartment 5 for the starting device via inner portion of a separating wall 21 of the socket. The electrode is finally connected to the harness assembly 8, which leads to the main body of the starting apparatus via the inputting connector 7.

Figure 3:
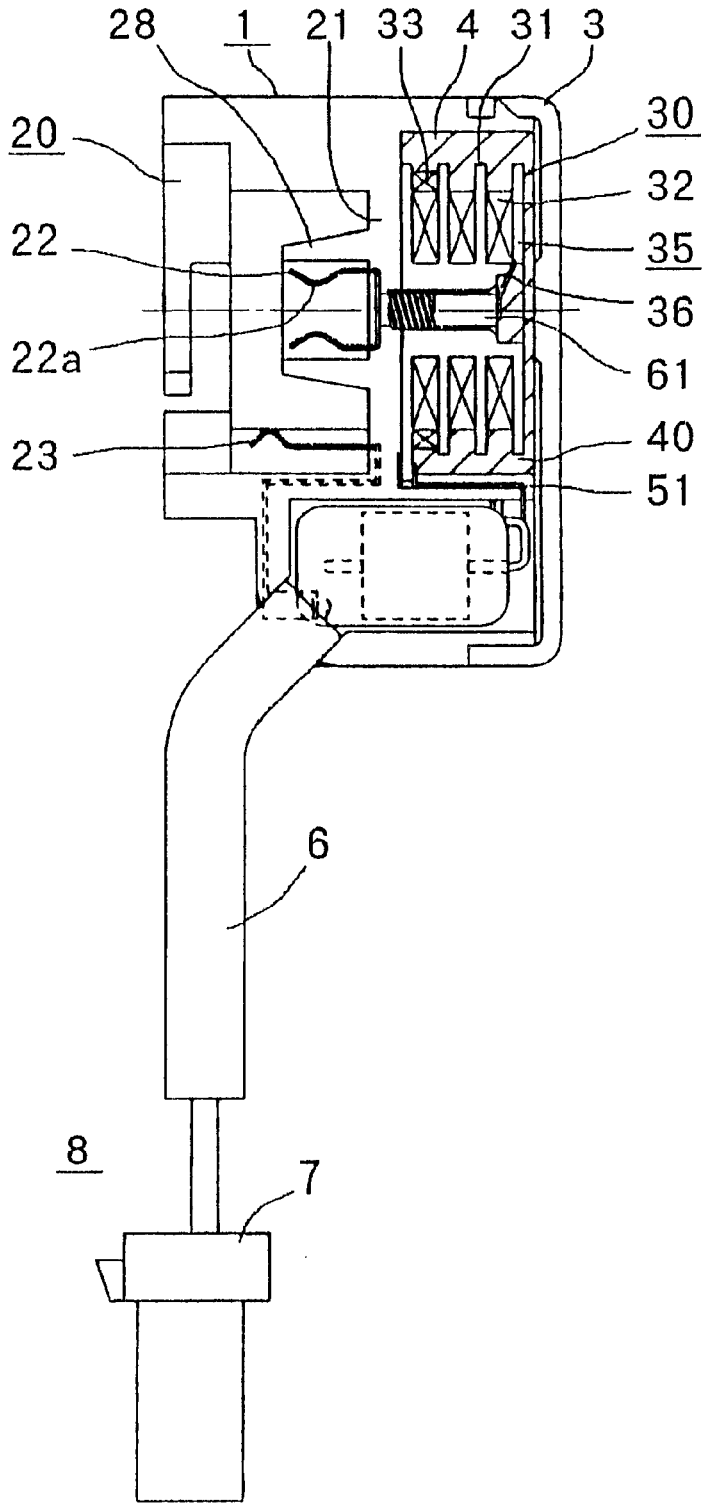
FIG. 3 is a cross sectional view depicting a constitution of a second embodiment according to the present invention.
Figure 4:
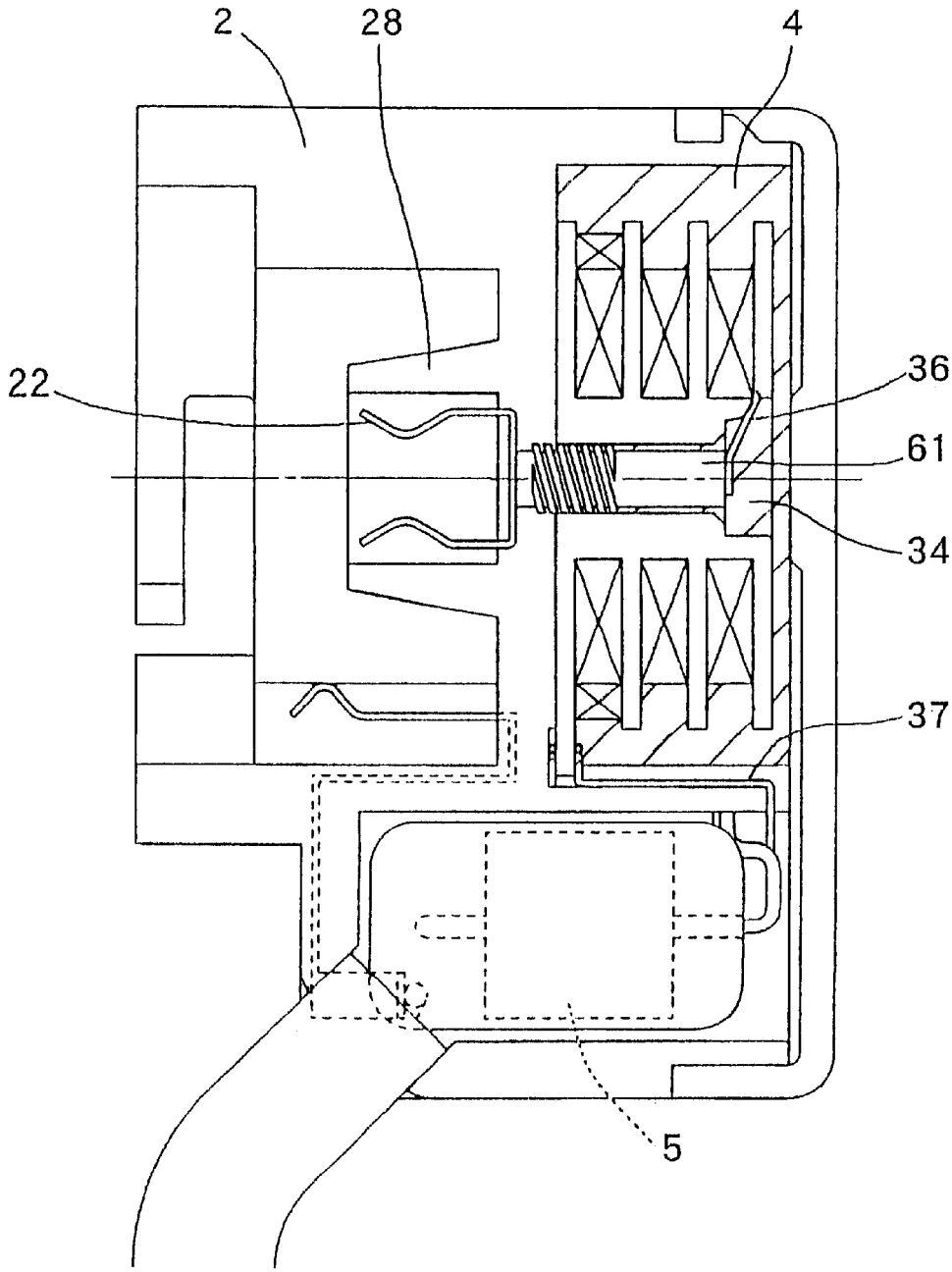
FIG. 4 is an enlarged view of the main portion of FIG. 3.
Figure 5A:
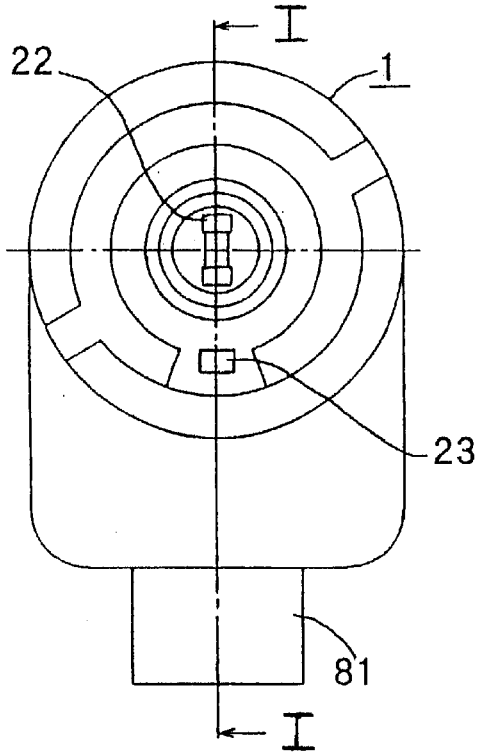
FIGS. 5A to 5D show a constitution of a third embodiment having a direct coupler according to the present invention.
Figure 5B:
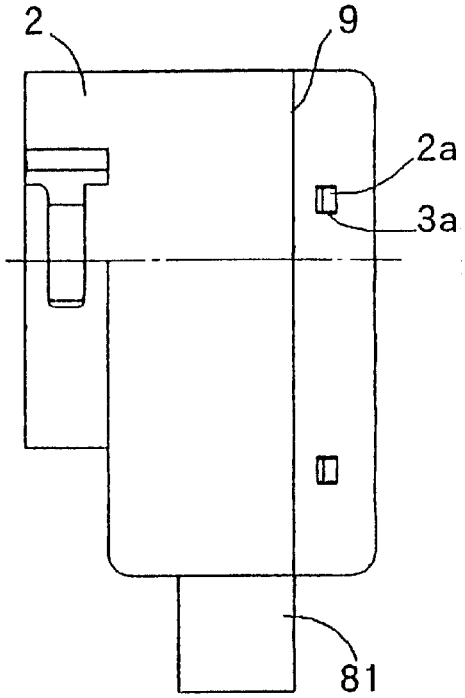
Figure 5C:
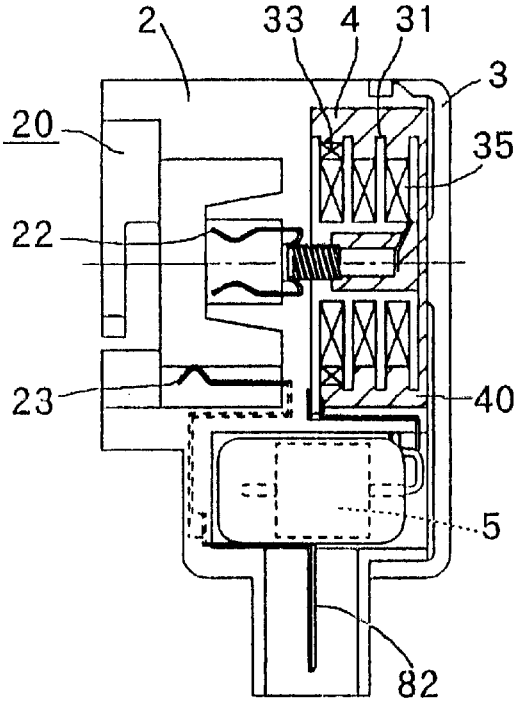
Figure 5D:
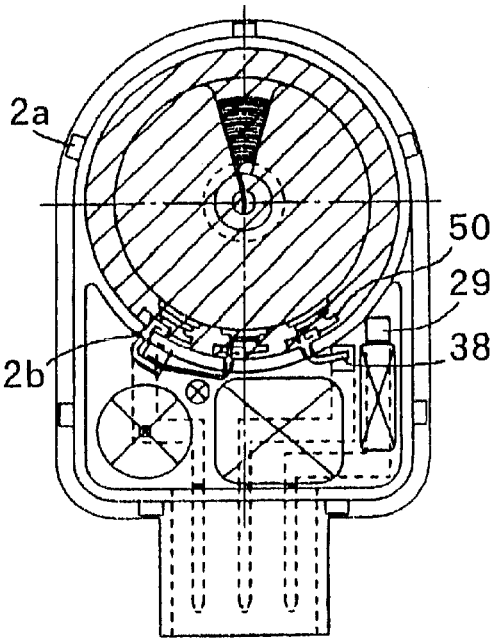

Hereinafter the second embodiment is explained by referring FIG. 3 and FIG. 4. In this embodiment a male screw is formed at the bottom portion of a high voltage electrode 22. A female screw is formed at one end of a screw electrode 61 built in the core-less portion 34 (a central portion of the bobbin 31, i.e., a central portion of the socket 20) of the bobbin 31. Since this constitution is quite the same as the embodiment 1 except that the male screw and the female screw are replaced each other, further detailed explanation is omitted.

A leading wire 36 is welded to the other end (with no screw formed) of the screw electrode 61 to form as an electrode rod. Thus simultaneous electrical and structural connections can be attained via the screw electrode 61 when the coil 35 is fixed to the case 2.

Hereinafter the third embodiment shown in FIGS. 5A to 5D is explained. An electrical connection between the main body of the starting device and starting device for lamp lighting is attained by connecting a direct coupler equipped on the main body of the starting device to a direct coupler 81 equipped on the starting device for lamp lighting, via a harness having a connector (not shown).

Input terminals 82 (3 terminals +400 V, −600 V and GND in FIGS. 10A and 10B) equipped in the direct coupler 81 are metal electrodes formed in one-pieced member (formed in the socket case 2 or 3 by an insert molding) combined with a HID-GND electrode and an electrode 23 at a low voltage side of the secondary coil 32 or formed in separated members. Since only this forming method of the metal electrodes is different from those of preceding embodiments 1 and 2, further detailed explanation is omitted.

Herein after the fourth embodiment is explained by referring FIGS. 6A to 6C and FIG. 7. In this embodiment, a high voltage electrode 22 is formed at a central axis of the bobbin 31 of the above-mentioned core-less transformer 30 in the device. It has an insulating wall 28, a portion of a movable high voltage electrode holder 26 with a circular or rectangular cross-section. The socket case 2 and the bobbin 31 are molded into one piece. The above-mentioned constitution realizes a smaller and lighter apparatus which attains simultaneous electrical and structural connections between the high voltage electrode 22 and the secondary coil 32 of the transformer 30 for preventing damages caused by vibrations and impacts etc.

Figure 6A:
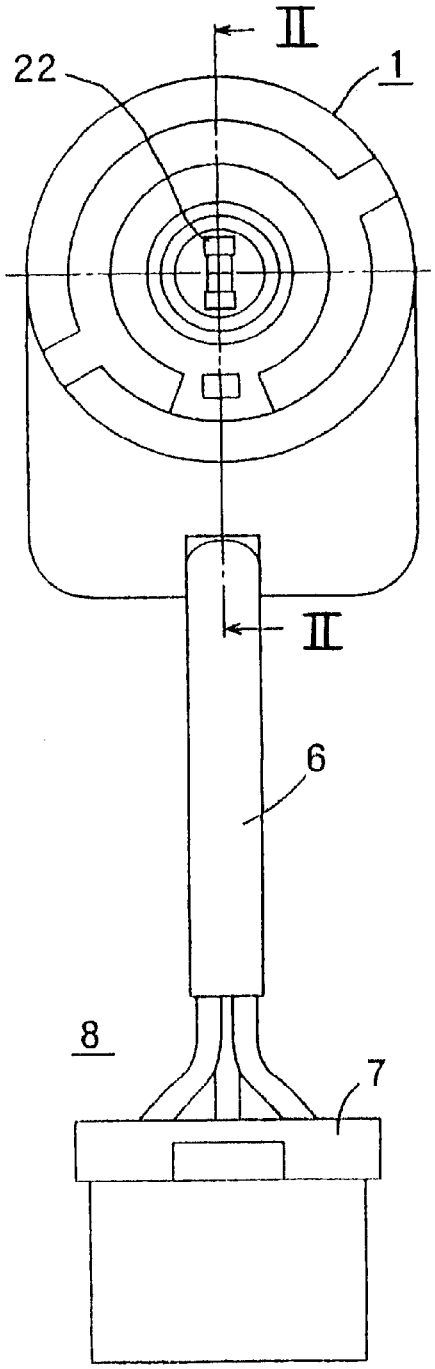
FIGS. 6A to 6C show a constitution of a fourth embodiment according to the present invention.
Figure 6B:
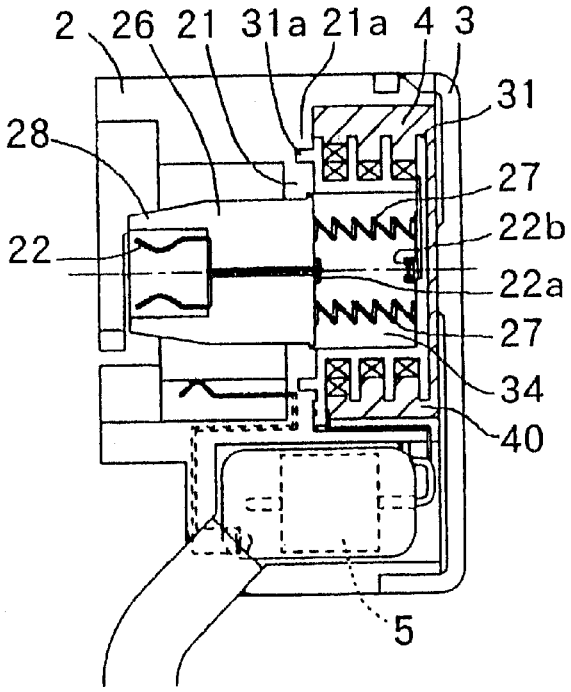

In this embodiment, the movable high voltage electrode holder 26 equipped with a switch is used so as to prevent generating the starting pulse, when there are no or incomplete connections between the lamp and socket even if a power is applied between them. When the lamp is not mounted to the socket as shown in FIG. 6B, the movable high voltage electrode holder 26 is protruded by springs 27 (consisted of 1 to 4 springs or the like having spring property), where a switch comprised by one end 22*a* of the high voltage electrode 22 and a high voltage electrode 22*b* of the starting transformer functions as "off" (22*a* and 22*b* are apart from each other), as a result no starting pulses are generated even if power is applied.

Figure 17:
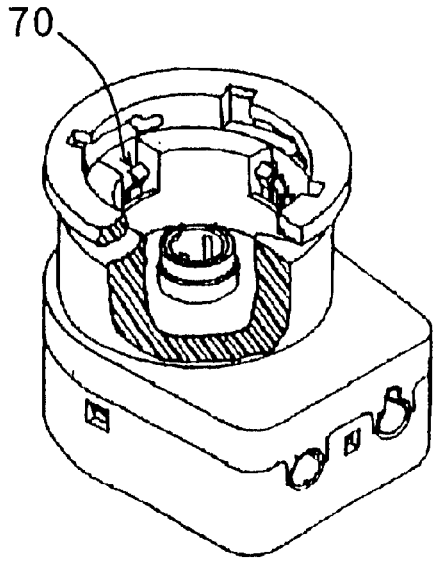
FIG.17 (PRIOR ART)
FIG. 17 shows a conventional lamp socket fitted with check terminals (detecting terminals) so as to detect whether the lamp is mounted or not.

When the switch keeps in a state of "on" even when the lamp is removed from the socket, the double safety is ensured by the protruded high voltage movable electrode holder 26 1 to 10 mm more against the GND electrode in the inserting direction of the lamp so that an enough creepage distance is kept to prevent leakage between them. Due to this safety measure, a conventional check terminal (detecting terminal) shown in FIG. 17 is not required any more.

Figure 6C:
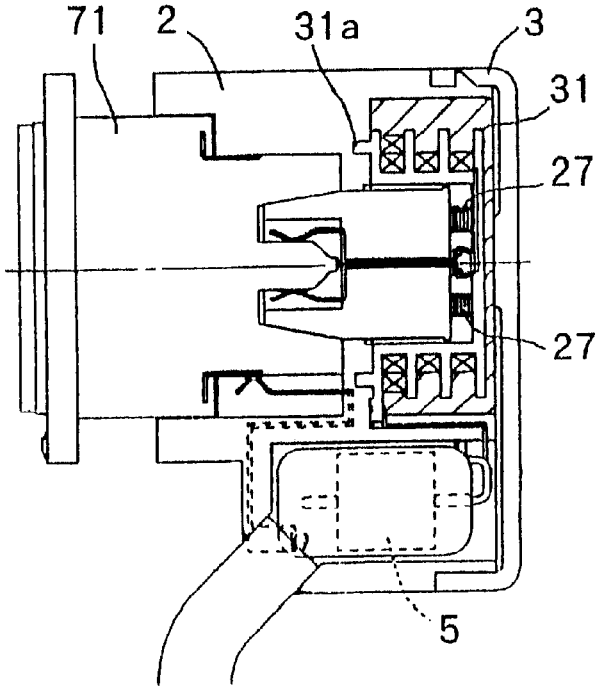
Figure 7:
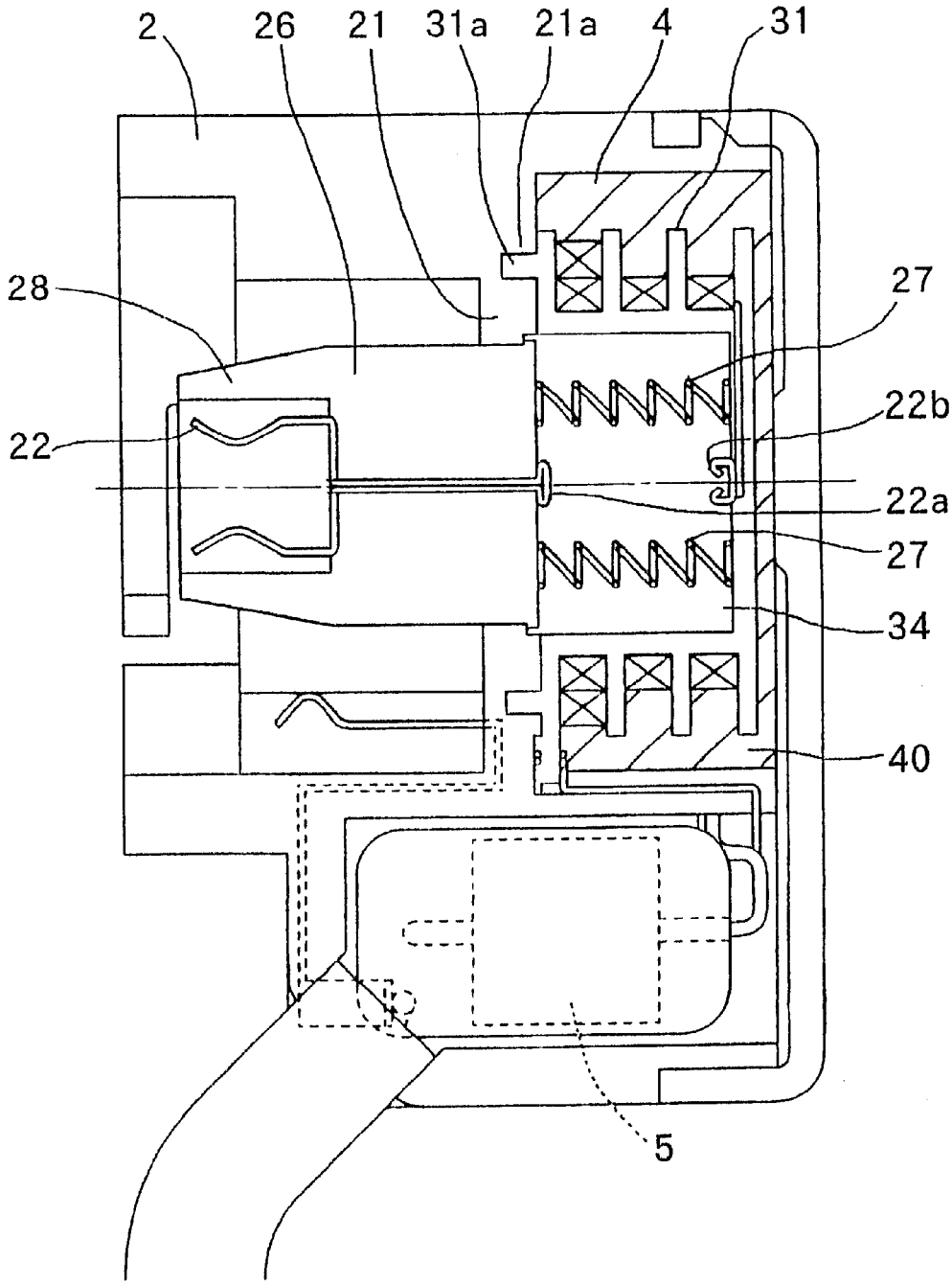
FIG. 7 is an enlarged view of FIG. 6B.
Figure 8A:
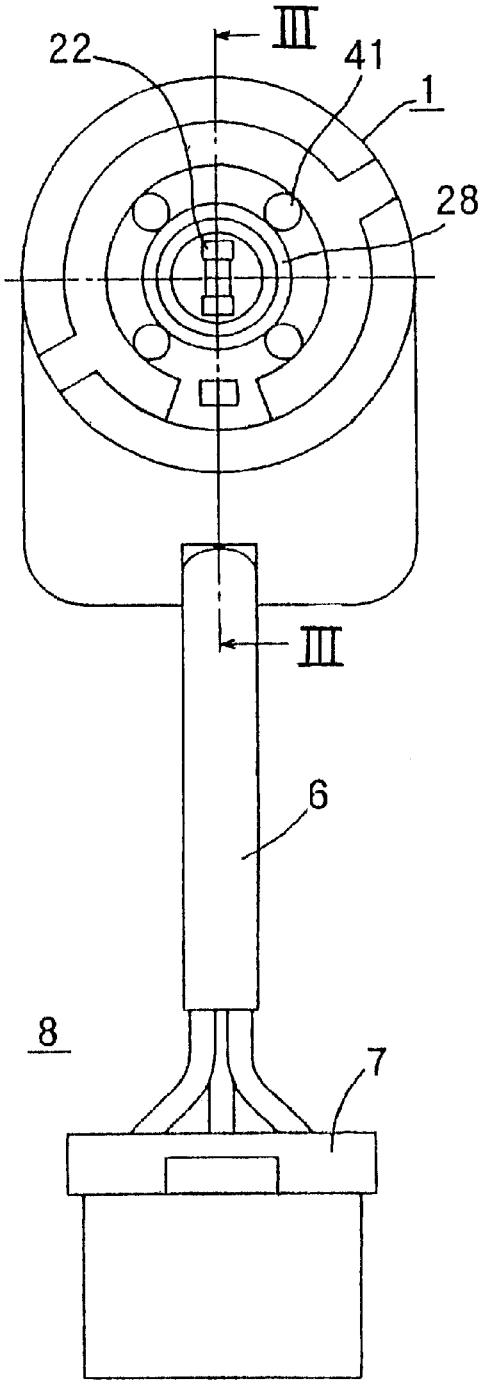
FIGS. 8A and 8B show a constitution of a fifth embodiment according to the present invention.
Figure 8B:
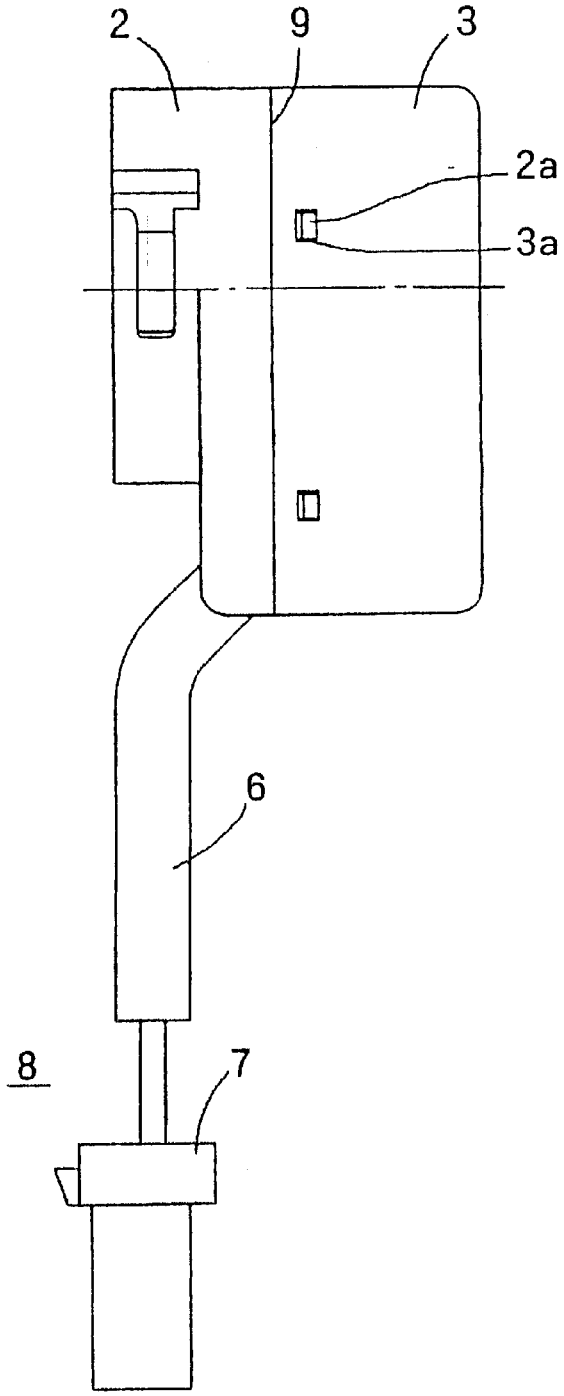
Figure 9A:
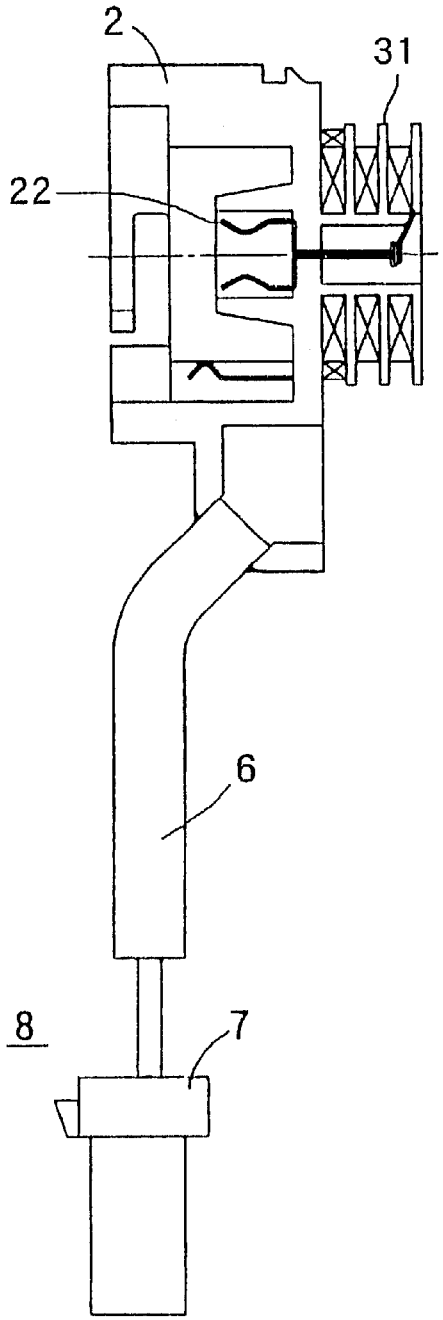
FIGS. 9A and 9B show cross sectional views along line III—III in FIG. 8A.
Figure 9B:
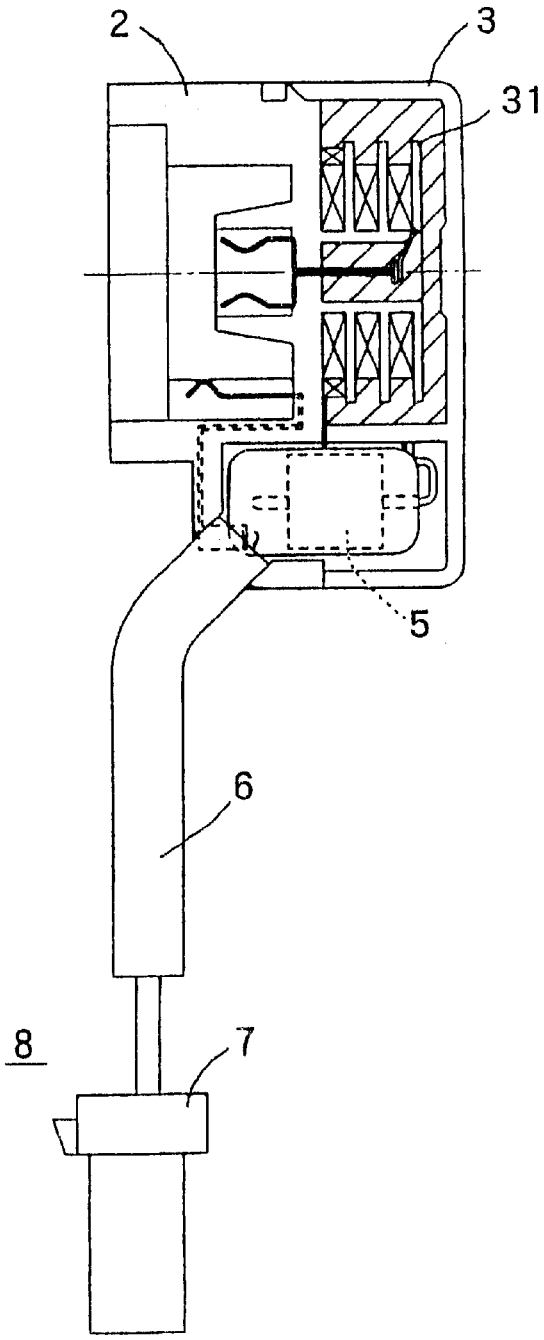

When the lamp is mounted to the socket via a lamp base 71 as shown in FIG. 6C, the movable high voltage electrode holder 26 is pushed into the core-less space 34 of the transformer 30 so that 22*a* contacts to 22*b*. (a state of "on") Due to the core-less space 34, the above-explained structure can be realized. The bobbin 31 has an opening on only one side facing the socket separating wall 21. When the molding material 40 is cast into the transformer accommodating compartment 4, the molding material is kept from flowing into the core-less space 34 by mating a protruded cylindrical portion 31*a* of the bobbin 31 with a groove 21*a* on the socket separating wall 21.

Referring to FIGS. 8A, 8B and FIGS. 9A, 9B, the fifth embodiment according to the present invention is explained. These figures show a structure to reduce parts number and manufacturing cost, where the socket case 2 and the bobbin 31 are formed in one piece. In this structure, the wall enclosing the starting transformer accommodating compartment 4, formed at the rear side of the socket 2 in the embodiments 1 to 4, is abolished so as to wind coil around the bobbin 31 even after assembling the socket and the bobbin together. Therefore the connecting line i.e. the parting line 9 between the socket cases 2 and 3 is formed at a different position from preceding embodiments. (Compare FIG. 8A with FIG. 5B.)

After winding coils 32 and 33 around the bobbin 31, leading wires 36, 37 and 38 are led and connected to respective positions in the starting circuit. The socket case 3 is fitted to socket case 2. In order to insulate the starting transformer 30, a molding material 40 is poured via openings 41 (In FIG. 8A, 4 circular openings are illustrated, but different number and shape are also employable.) formed in the vicinity of the insulating wall 28 of the socket case 2. In some cases, a vacuum casting method is employed to remove bubbles to ensure further insulation.

Figure 10A:
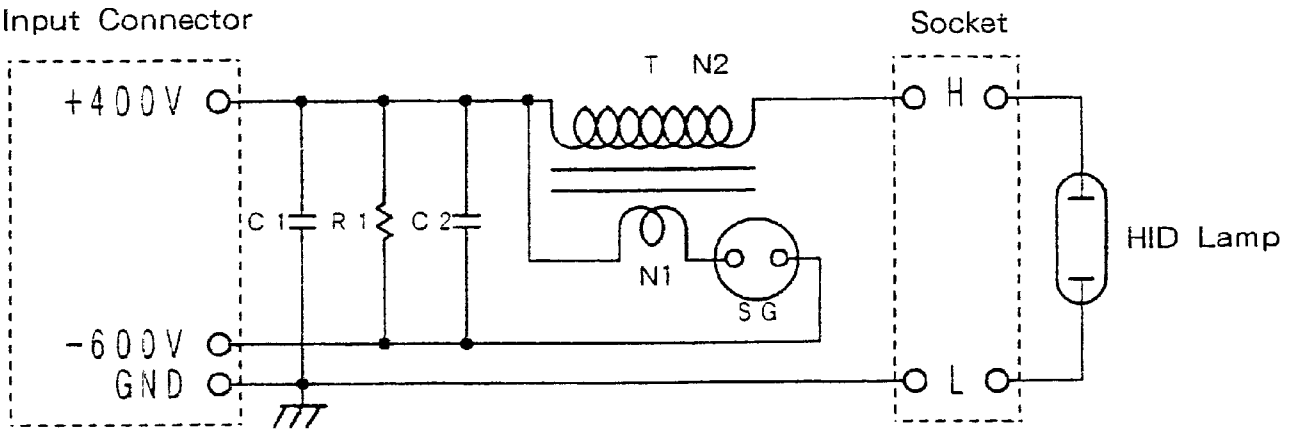
FIGS. 10A and 10B show starting circuit diagrams.

Hereinafter a starting lamp circuit depicted in FIG. 10A is described. Input powers supplied from the main body of the starting device (not shown in the figure) are +400 V, GND as main powers and −600 V as a power for SG (spark gap), a trigger element for high voltage pulse. In these embodiments the SG having a break down point of 800 kV is selected among SGs for car use having the break down points between 400 V and 3 kV. The power −600 V is supplied to the starting device circuit via resistance (not shown) connected in series to the output terminal. A constant determining a pulse cycle (usually between 30 to 150 Hz) is determined by applying 1 kV (voltage between the two terminals −600 V and 400 V) to a circuit where the above-mentioned resistance (not shown) and a charging/discharging capacitor C2 are connected in series.

When a voltage in the capacitor C2 reaches the break down point (In case of the SG of 800 V the value is 800 V +/−15%.) a electric current starts to flow in a primary coil N1 of the starting transformer T, which induces a high voltage in a secondary coil N2.

The induced high voltage generates a starting pulse (ca. 25 kV) at the power +400 V, as a result the HID lamp is activated. In a circuit depicted in FIG. 10B the HID lamp is switched on and off via a lamp detecting SW (switch) equipped in the socket where the switch is on when the HID lamp is mounted and vice verse. In these figures C1 is a capacitor used as a filter for the input powers and R1 is a resistance for discharging electric charge stored in the capacitor C2.

Figure 11:
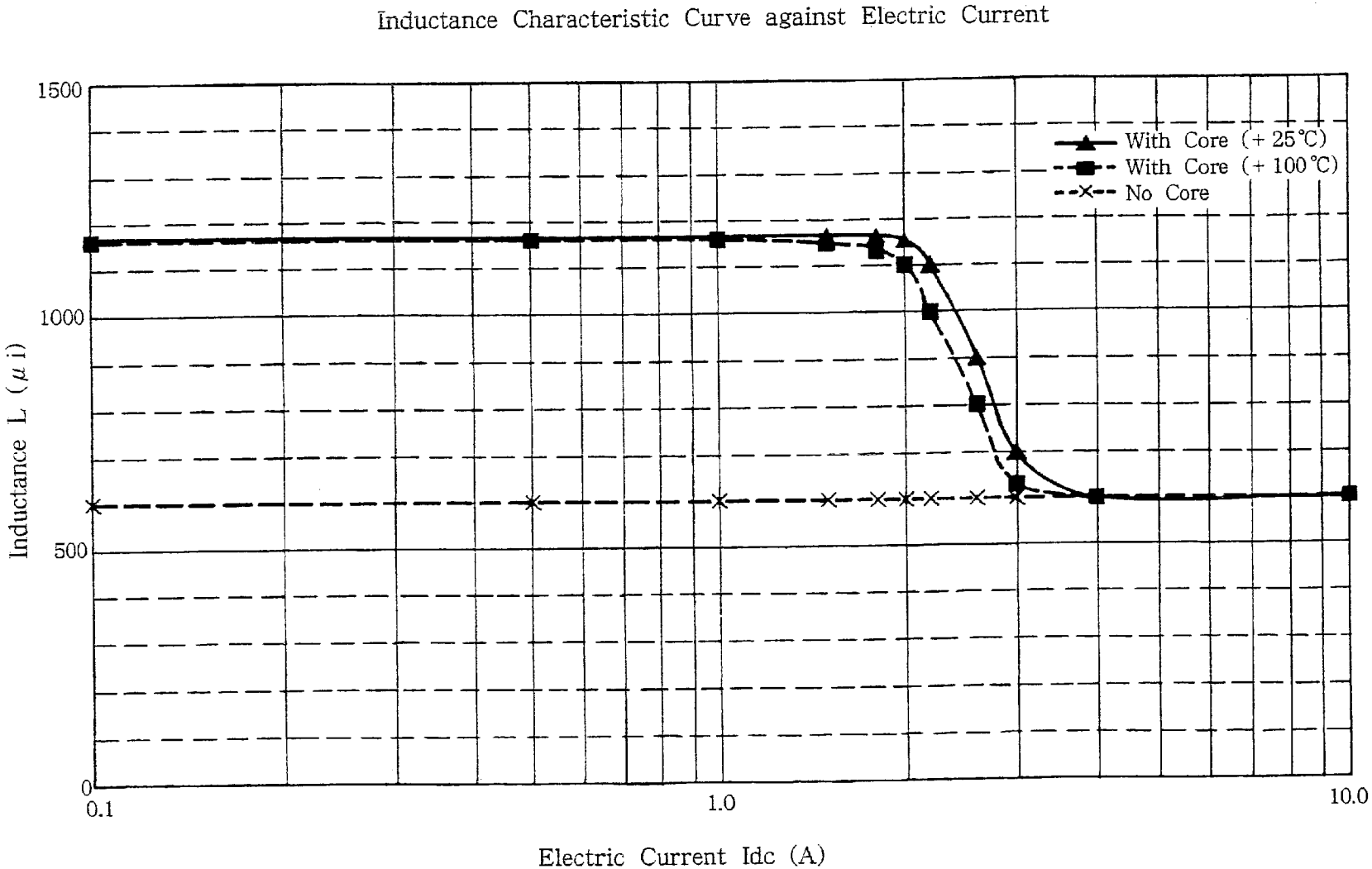
FIG. 11 depicts inductance characteristic curves against electric current of starting transformers with/without core.

Hereinafter inductance characteristics of coils with core or without core are explained. FIG. 11 (an abscissa is electric current scale and an ordinate is inductance scale) shows that in coils with core inductance value start decreasing from a certain electric current value (in this case 2.0 A) and finally reach a constant value (saturated phenomena), in accordance with increasing electric current. When the ambient temperature is raised (+100° C.) the inductance value reaches the saturated phenomenon at a lower electric current value than that of the ordinary temperature (+25° C.). However in case of a coil without core the inductance keeps a constant value independent from changes of the electric current value and the ambient temperature.

Figure 12:
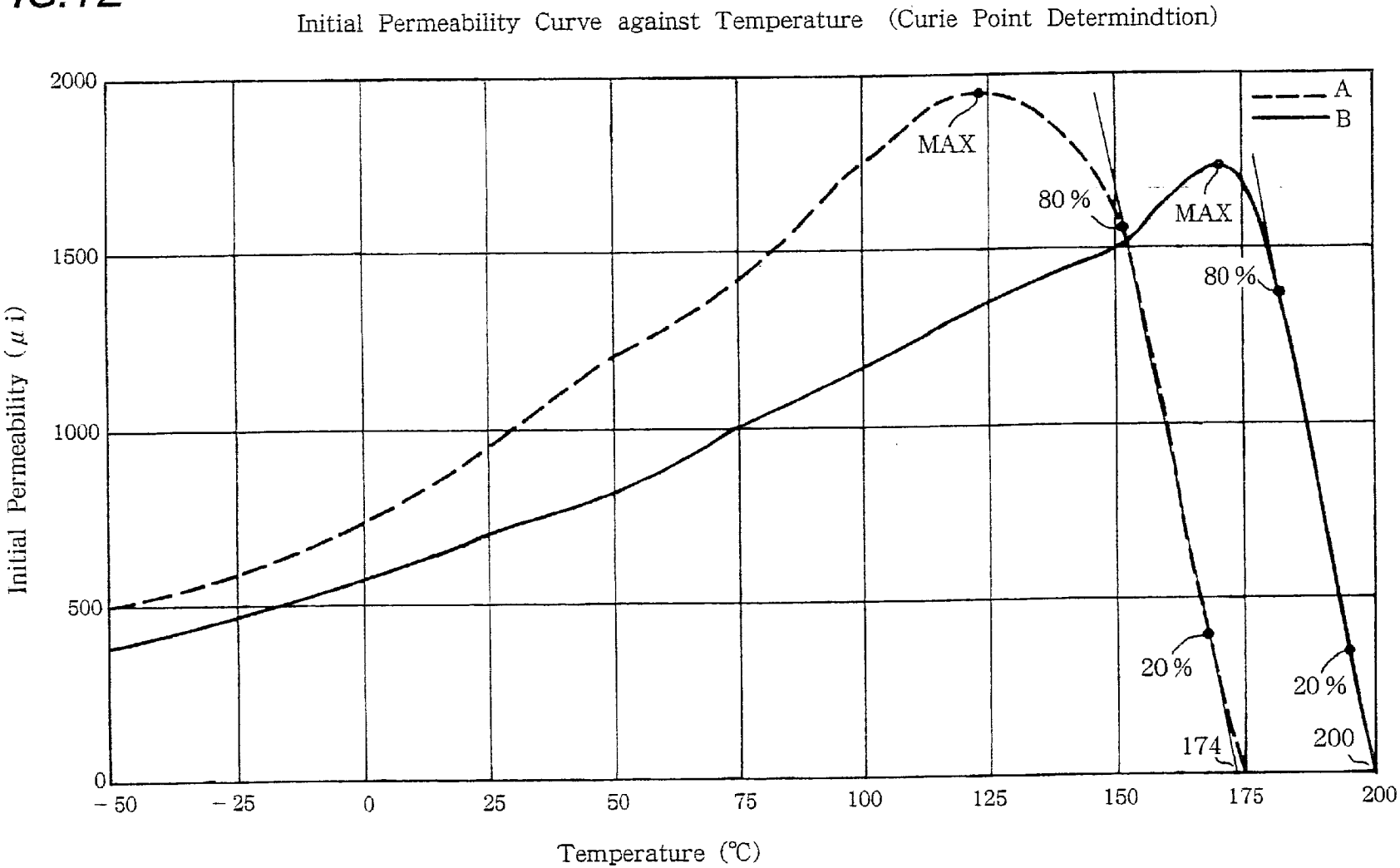
FIG. 12 depicts initial permeability curves of ferrite cores against temperature (Curie point determination curve).

In FIG. 12 (an abscissa is temperature scale and an ordinate is initial permeability scale) initial permeability curves of cores (A and B types) against temperature for determining Curie point are plotted. Ni-ferrite cores are employed in both A and B types. A Curie point means a critical temperature where a magnetic property of a core changes from ferromagnetic to paramagnetic. Practically the Curie point is determined as follows: On a declining portion of the initial permeability ($\mu i$) curve against increasing temperature, two points, 80% and 20% of the maximum initial permeability, are determined and a line determined by the above-mentioned two points is extrapolated up to a point where $\mu i$=1.0, a temperature value at this point is defined as the Curie point.

Figure 10B:
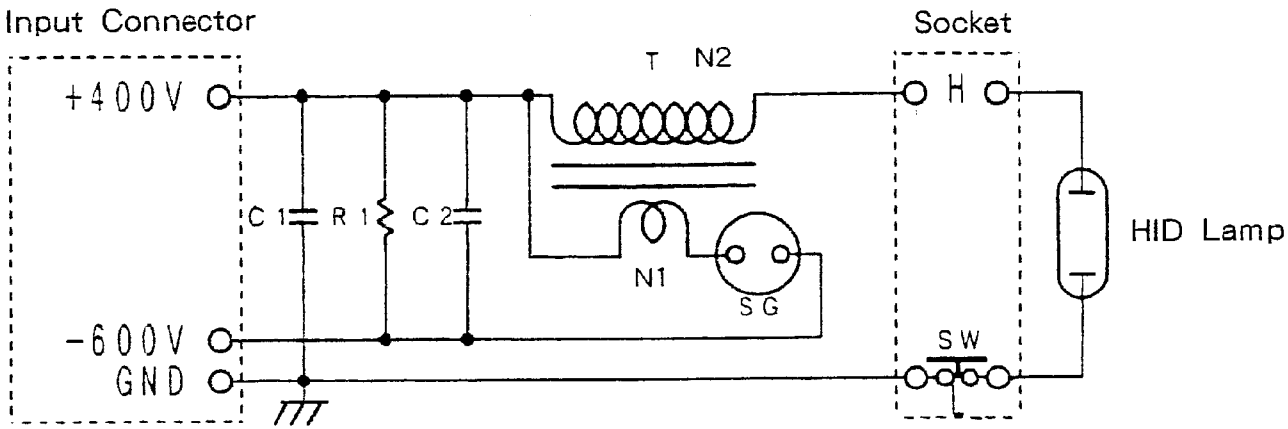

By the above-mentioned method the Curie point of the A type core is determined 174° C. and that of the B type core is determined 200° C. Considering that the core is employed for car use and is equipped near the HID lamp, a core with higher Curie point is favorable, but $\mu i$ reciprocally decreases against the increased Curie point. In other words a coil with more turns are needed to obtain a required inductance value when a core with higher Curie point is used. The coil occupies more space and results in a larger sized starting device. In addition a resistance value in the coil is increased so that a power loss due to the increased resistance value is added to the circuit where the secondary coil N2 of the transformer T is directly connected to the power line +400 V as shown in FIGS. 10A and 10B. Which results in decreasing the efficiency of the starting circuit. Since the cores with high Curie points are circulated not so many in the market and usually are not used, producing these cores requires higher cost. The coil with core-less structure employed in the present invention solves above-mentioned problems.

As explained above, since the core-less structure according to the present invention has no electric current saturation and is not influenced by the ambient temperature, a smaller and lighter device can be realized. As a result the following advantages are attained in producing the starting device for lamp lighting and its components. (a) Breakage of the device caused by vibrations and impacts etc. is prevented by arranging the starting transformer on the same central axis of the socket. (b) Life of the HID lamp is prolonged by employing divided winding around the bobbin of the transformer for increasing the distributed capacity. (c) Electrical and structural connection (supporting the starting transformer) between the high voltage electrode terminal and the coil of the starting transformer by employing screwed electrodes on both sides. (d) A safety mechanism to prevent the starting pulse from generating when the HID lamp is not mounted by forming the movable high voltage electrode holder and the switching mechanism in the core-less space of the coil of the starting transformer. (e) The device can be fitted to every type of cars by attaining various connecting methods between the main body of the lamp lighting device and the starting device for lamp lighting.

In other words the following effects are attained in each component of the device.

(1) Core-less coil structure

No electric current saturation (In the transformer with core the inductance value is saturated from a certain electric current value.)

Independent from the ambient temperature (In the transformer with core the inductance value at higher temperature, ca. 100° C., is saturated at lower electric current value. A magnetic substance having the Curie point is never used at higher temperature than the Curie point.)

Efficiency of the starting circuit can be increased due to the reduced resistance value of the secondary coil attained by the bobbin with smaller diameter.

The core-less space at the center of the coil enables the socket case and the coil to be aligned on the same center axis. Which results in an easy connection between the output leading wire on high voltage side of the coil and the socket terminal arranged on the opposite side. And an excellent insulation is realized by casting the molding resin material into the core-less space.

Costs for material and assembly are reduced.

Weight i.e. size of the device is reduced.

(2) Alignment of the transformer at the center of the socket

Since the transformer, the heaviest component in the device, can be arranged at the center of the discharging lamp, a good weight balance of the device is attained. Smaller sized device can be obtained by arranging the transformer at the center of the socket.

(3) Divided coil winding around the bobbin of the starting transformer

The wider width of the outputting pulse is obtained by the divided winding resulting in the higher distribution capacity (several hundred times to several thousand times) among wires in the secondary coil. Which results in relieving a stress imposed on the lamp electrode, reducing wear of the electrode and further prolonging the lamp life.

(4) The connecting structure employed screws in the terminal of the high voltage electrode and in the screw electrode connected to the secondary coil of the starting transformer.

Since the electrical and structural connections are carried out simultaneously, reliability and operability of the apparatus are improved, and in addition assembling man-hours are reduced.

(5) Lamp detecting mechanism

When the HID lamp is not mounted, the pulse generation between the high voltage electrode in the socket and the GND electrode is prevented, i.e. in the worst case flaring, fuming or electrical shock to the operator is prevented. The above mentioned measures are realized by the following steps. (1) Protruding the movable high voltage electrode holder 1 to 10 mm more than the unmovable GND electrode by the spring member. (2) Arranging the switching mechanism comprising of the lamp side electrode terminal at the bottom portion of the movable electrode holder and of the high voltage electrode terminal at the bobbin of the starting transformer so that the switching mechanism is set at an off state. When the HID lamp is mounted, the movable electrode holder is accommodated in the core-less space formed at the center portion of the transformer so that the switching mechanism is set an on state, which enables the HID lamp to light and to function as the lamp detecting means.

(6) Connection between the main body of the device and lamp lighting device

By employing the harness equipped with the connector, coupler (connector) portion of the harness can be formed smaller then the direct coupler method. In some direct coupler methods, since a length of the harness equipped with the connector is adjustable to desired length, it can be easily applied to different types of cars.

What is claimed is:

1. A starting device for a discharge lamp comprising;

a socket equipped with a high voltage electrode and a grounding electrode for mounting said discharge lamp, a bobbin, a starting transformer with a core-less structure consisting of a primary coil and a secondary coil wound around said bobbin and a screw electrode arranged at the center of one end face of said bobbin; wherein one end of said screw electrode is connected to an output terminal of a high voltage side of said secondary coil on said starting transformer and the other end of said screw electrode is screwed and connected to a terminal of said high voltage electrode of said socket.

2. The starting device for the discharge lamp according to claim 1, wherein a harness with connector is arranged.

3. A starting device for a discharge lamp comprising;

a socket for mounting said discharge lamp equipped with a high voltage electrode fitted to a movable electrode holder moved by a spring member and equipped with a grounding electrode, a bobbin, a starting transformer with a core-less structure consisting of a primary coil and a secondary coil wound around said bobbin and, a switching mechanism consisting of a fitted end of said high electrode and a high voltage electrode formed on said bobbin; wherein when said discharge lamp in not mounted an insulating wall is protruded by said spring mechanism 1 to 10 mm more than said grounding electrode so that said switching mechanism is not activated, when said discharge lamp is mounted said movable electrode holder is accommodated in said core-less structure of said bobbin so that said switching mechanism is activated and works as a discharge lamp detecting means.

4. The starting device for the discharge lamp according to claim 3, wherein a harness equipped with connector is arranged.

* * * * *